US009509052B1

(12) United States Patent
Tam

(10) Patent No.: US 9,509,052 B1
(45) Date of Patent: Nov. 29, 2016

(54) ANIMAL BODY ANTENNA

(75) Inventor: Daniel W. Tam, San Diego, CA (US)

(73) Assignee: The United States of America as represented by Secretary of the Navy, Washington, DC (US)

( * ) Notice: Subject to any disclaimer, the term of this patent is extended or adjusted under 35 U.S.C. 154(b) by 1449 days.

(21) Appl. No.: 13/021,431

(22) Filed: Feb. 4, 2011

(51) Int. Cl.
*H01Q 7/08* (2006.01)

(52) U.S. Cl.
CPC ..... *H01Q 7/08* (2013.01)

(58) Field of Classification Search
USPC ..... 343/718
See application file for complete search history.

(56) References Cited

U.S. PATENT DOCUMENTS

| | | | | |
|---|---|---|---|---|
| 3,329,957 | A | 7/1967 | Hoynes | |
| 4,680,538 | A * | 7/1987 | Dalman et al. | 324/638 |
| 5,394,164 | A | 2/1995 | Gandhi et al. | |
| 5,633,648 | A | 5/1997 | Fischer | |
| 5,678,202 | A * | 10/1997 | Filimon et al. | 455/575.7 |
| 5,792,668 | A * | 8/1998 | Fuller et al. | 436/149 |
| 6,047,163 | A * | 4/2000 | Miyoshi | 455/39 |
| 6,439,941 | B2 * | 8/2002 | McClure et al. | 441/89 |
| 6,492,956 | B1 * | 12/2002 | Fischer et al. | 343/788 |
| 6,597,320 | B2 * | 7/2003 | Maeda et al. | 343/718 |
| 7,002,526 | B1 | 2/2006 | Adams et al. | |
| 8,059,045 | B1 * | 11/2011 | Schaffner et al. | 343/718 |
| 2001/0011155 | A1 * | 8/2001 | Rapoport | 600/407 |
| 2008/0158432 | A1 | 7/2008 | Hwang et al. | |

OTHER PUBLICATIONS

Unpublished, pending U.S. Appl. No. 12/330,307, filed Dec. 8, 2008, by Tam, Daniel W.S., titled "Multi-band Tree Antenna", (Navy Case # 98608).
Unpublished, pending U.S. Appl. No. 12/964,517, filed Dec. 9, 2010, by Tam, Daniel W., titled "Structure Characteristic Impedance Estimator Using Current Probe", (Navy Case #100476).

* cited by examiner

*Primary Examiner* — Dameon E Levi
*Assistant Examiner* — Andrea Lindgren Baltzell
(74) *Attorney, Agent, or Firm* — SPAWAR Systems Center Pacific; Kyle Eppele; J. Eric Anderson

(57) ABSTRACT

An antenna comprising: a transceiver; a current probe operatively coupled to the transceiver, wherein the current probe comprises an outer conductive non-magnetic housing, a toroidal magnetic core having a central aperture, wherein the core is insulated from the housing, and a primary winding wound about the core; and an animal body, a portion of which is positioned within the aperture such that incoming and outgoing electromagnetic signals are transferred between the portion of the animal body and the current probe by magnetic induction.

19 Claims, 10 Drawing Sheets

ANIMAL BODY ANTENNA

FEDERALLY-SPONSORED RESEARCH AND DEVELOPMENT

This invention is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; voice (619) 553-2778; email T2@spawar.navy.mil. Reference Navy Case Number 100653.

BACKGROUND OF THE INVENTION

Field of the Invention

This invention relates to an apparatus for coupling radio frequency (RF) energy to and from an animal body for radiation and, more specifically, providing the coupling by current injection by way of magnetic induction.

Current probes have been used by others to magnetically couple RF energy to metallic structures. For example, U.S. Pat. No. 6,492,956 to Fischer et al., which is incorporated by reference herein, describes an embodiment of a current probe that may be used for injecting current into a portion of existing vehicles, buildings, or ships. A need exists for an antenna that does not require a metallic radiating structure.

SUMMARY

Described herein is an antenna comprising: a transceiver; a current probe operatively coupled to the transceiver, wherein the current probe comprises an outer conductive non-magnetic housing, a toroidal magnetic core having a central aperture, wherein the core is insulated from the housing, and a primary winding wound about the core; and an animal body, a portion of which is positioned within the aperture such that incoming and outgoing electromagnetic signals are transferred between the portion of the animal body and the current probe by magnetic induction.

Also described herein is a method for using an animal body as an antenna element comprising the following steps: providing a current probe, wherein the current probe comprises a conductive non-magnetic housing, a toroidal magnetic core having a central aperture, wherein the core is insulated from the housing, and a primary winding wound about the core; positioning a portion of the animal body within the aperture; exposing the animal body to an electromagnetic signal; sensing with the current probe by way of magnetic induction a current in the animal body; and determining antenna characteristics of the portion of the animal body based on the sensed current.

BRIEF DESCRIPTION OF THE DRAWINGS

Throughout the several views, like elements are referenced using like references. The elements in the figures are not drawn to scale and some dimensions are exaggerated for clarity.

DETAILED DESCRIPTION OF EMBODIMENTS

Figure 1:
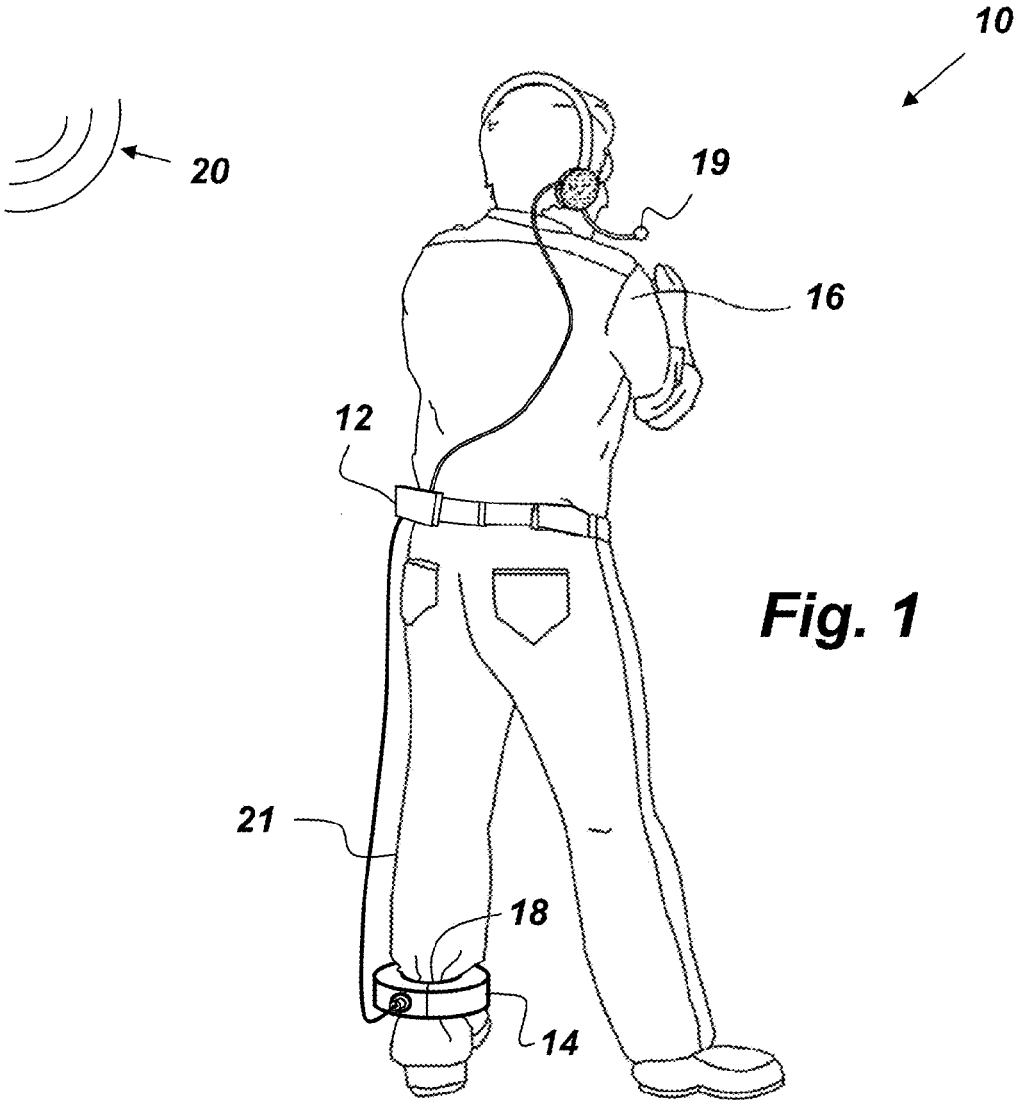
FIG. 1 is an illustration of an embodiment of an animal body antenna.

FIG. 1 is an illustration of an antenna system 10 comprising a transceiver 12, a current probe 14, and a portion of an animal body 16. The portion of the body 16 is positioned within an aperture 18 of the current probe 14, and the current probe 14 is operatively coupled to the transceiver 12. In this configuration incoming and outgoing electromagnetic signals 20 are transferred between the portion of the body 16 and the current probe 14 by magnetic induction. As used herein, the term "animal" includes all members of the Animalia kingdom, including, but not limited to, human beings. The current probe 14 may be positioned around any portion of the body 16 that fits within the aperture 18, including, but not limited to, arms, legs, fingers, tails, torsos, necks, etc. The electromagnetic signals 20 may be any signal of opportunity or a specific signal of interest. Signals of opportunity include, but are not limited to, AM/FM broadcasting stations and broadcast television signals. Specific signals of interest include, but are not limited to ham radio signals, signals from a local transmitter transmitting a time pulse or any other transmitter transmitting a narrowband frequency. The electromagnetic signals 20 may be either received or transmitted by the antenna system 10. The antenna system 10 may be used with any many different types of devices that require an antenna. For example, the antenna system 10 may be used as the antenna for a radio, cell phone, a wireless microphone, a tracking system, a location finder, etc. FIG. 1 is one example embodiment of the antenna system 10 wherein the body 16 is that of a human—in this case a man. In the embodiment shown, the current probe 14 is positioned around the man's leg 21, just above his ankle. A microphone 19 converts his words into an electromagnetic signal 20, which is conducted to the transceiver 12 and then is wirelessly transmitted to a remote location (not shown) with the current probe 14 and the body 16 together functioning as a transmit antenna.

The transceiver 12 may be any HF/VHF/UHF/SHF/EHF transmitter, receiver, transceiver, antenna analyzer/network analyzer or spectrum analyzer. For example, when the antenna system 10 utilizes a human body as the animal body 16, the transceiver 12 may be a VHF transceiver. For an embodiment of the antenna system 10 where the current probe 14 is clasped about a human's ungrounded ankle (as shown in FIG. 1), a suitable example of the transceiver 12 is, but is not limited to, a handheld Yaesu® RT-11R 2 meter VHF transceiver. Another suitable example of the transceiver 12 is an Anritzu® Site Master S312D antenna analyzer and spectrum analyzer with a frequency range from 9 KHz to 1,600 MHz. The antenna system 10 may be used to transmit and receive signals at VHF frequencies by local simplex operation as well as by remote repeater operation. The transceiver 12 may be any desired size or shape depending on the application.

Figure 2A:
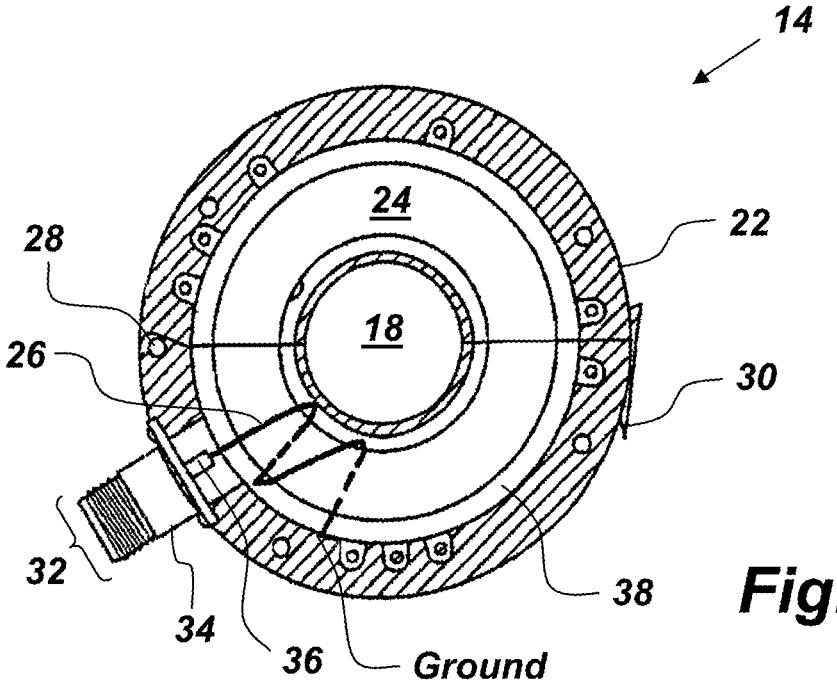
FIG. 2*a* shows a horizontal cross-sectional view of an embodiment of a current probe.
Figure 2B:
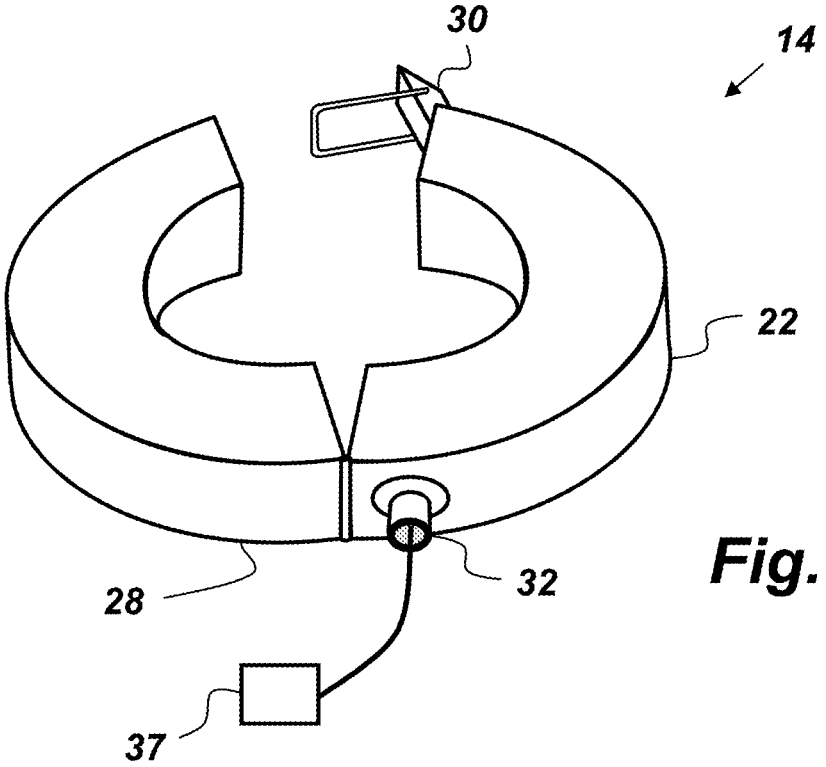
FIG. 2*b* is a perspective view of a current probe in an open configuration.

FIGS. 2*a* and 2*b* show one embodiment of the current probe 14 in more detail. In this embodiment, the current probe 14 comprises an outer conductive non-magnetic housing 22, a toroidal magnetic core 24 forming the central aperture 18, and a primary winding 26 wound about the core 24. FIG. 2*a* shows a horizontal cross-sectional view of the embodiment of the current probe 14 exposing the relationship of the core 24 and the primary winding 26. The current probe 14 may also comprise a feed connector 32. FIGS. 2*a* and 2*b* show the features that allow the shown embodiment of the current probe 14 to be clamped around the portion of the body 16. A hinge 28 allows the depicted embodiment of the current probe 14 to be hinged open and positioned around the portion of the body 16. In this embodiment, a releasable latch 30 allows the two core halves to be latched together.

Also shown in the embodiment of the current probe 14 depicted in FIG. 2*a*, the core 24 and primary winding 26 are contained within the housing 22 such that the core 24 is insulated from the housing 22. The core 24 may be comprised of any suitable magnetic material with a high resistivity. The primary winding 26 may be wound around the core 24 for any number of desired turns. The number of turns of the primary winding 26 and the core 24 materials will provide different inductive and resistive characteristics, affecting the frequency response of the current probe 14. The primary winding 26 may consist of a single turn around the core 24 or several turns around the core 24. The primary winding 26 may cover only one half of the core 24, or may extend around both core halves. The primary winding 26 may be terminated with a connection to the housing 22 as a ground, or it can be terminated in a balanced to unbalanced transformer (typically referred to as a BALUN). A radio frequency (RF) signal may be coupled into the current probe 14 through a feed connector 32. Examples of the feed connectors 32 include, but are not limited to: BNC (bayonet Neill-Concelman), SMA (SubMiniature version A), TNC (threaded Neill-Concelman), and N-style coaxial connectors. If a coaxial connector is used, a shield 34 portion of the connector 32 may be coupled to the housing 22, while an inside conductor 36 of the connector 32 is coupled to the primary winding 26.

The primary winding 26 and core 24 may be insulated from the housing 22 by an electrical insulating layer 38. The insulating layer 38 may comprise any suitable electrical insulating materials. The core halves of the core 24 are generally in contact with each other when the current probe 14 is closed. Although FIGS. 2*a* and 2*b* show the current probe 14 as configured to clamp around the portion of the body 16, it is to be understood that the manner of mounting the current probe 14 to the portion of the body 16 is not limited to clamping, but any effective manner of mounting the current probe 14 to the portion of the body 16 may be used. The current probe 14 may be any desired size and shape. For example, the current probe 14 may be the size and shape of a piece of jewelry such as a ring or bracelet, configured to be worn on a human finger or arm respectively. In addition, the current probe 14 may be integrated into an article of clothing and/or made of flexible material. In yet another example, the current probe 14 may be integrated into a personal flotation device.

As indicated above, the embodiment of the invention shown in FIGS. 2*a* and 2*b* may be clamped around a portion of a body 16 that is to be used as a transmitting antenna. Current flow in the primary winding 26 induces a magnetic field with closed flux lines substantially parallel to the toroidal core 24. This magnetic field then induces current flow in the portion of a body 16 clamped within the current probe 14, which results in RF energy transmission. A transmission line transformer 37 may optionally be used to couple the RF energy from the transceiver 12 to the current probe 14. If the primary winding 26 is terminated to the housing 22, an unbalanced to unbalanced (UNUN) transmission line transformer may be used to couple RF energy to the input end of the primary winding 26 of the current probe 14. Alternatively, a balanced to unbalanced transformer (BALUN) may be used to couple RF energy to the current probe 14. In this configuration, the primary winding 26 will not be terminated at the housing 22. Instead, both the input end and the termination of the primary winding 26 are connected to the balanced terminals of a BALUN. The unbalanced ends of the BALUN are connected to a coaxial cable carrying the RF energy from the transceiver 12. A BALUN may also be used if the current probe 14 has no external shield connected to ground. Use of transmission line transformers can improve impedance matching and reduce losses between the transceiver 12 and the current probe 14. Both BALUNs and UNUNs are well known in the art and are commercially available. However, specially made UNUNs may be required to properly match a transceiver 12 output to the input of the current probe 14.

In operation, the body 16 together with the current probe 14 may be used as an antenna element to measure antenna characteristics of the body 16 and or to transmit and receive electromagnetic signals 20. First the portion of the body 16 is positioned within the aperture 18. In order to receive RF signals, the body 16 is exposed to an electromagnetic signal 20, which creates a current in the body 16. That current is then sensed by way of magnetic induction by the current probe 14. Antenna characteristics of the portion of the body 16 may then be determined based on the sensed current.

Figure 3A:
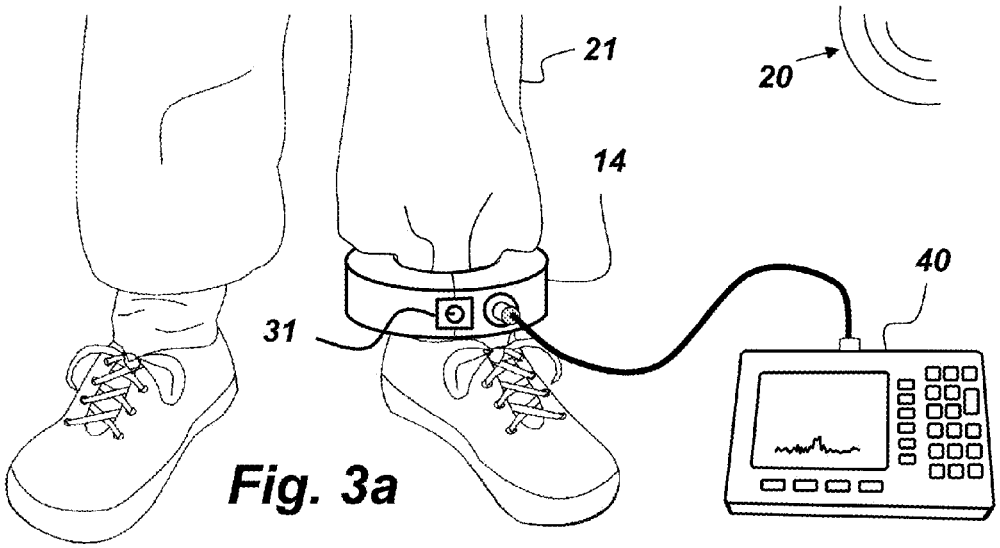
FIG. 3*a* is an illustration of a current probe positioned around a human leg and coupled to a spectrum analyzer.
Figure 3B:
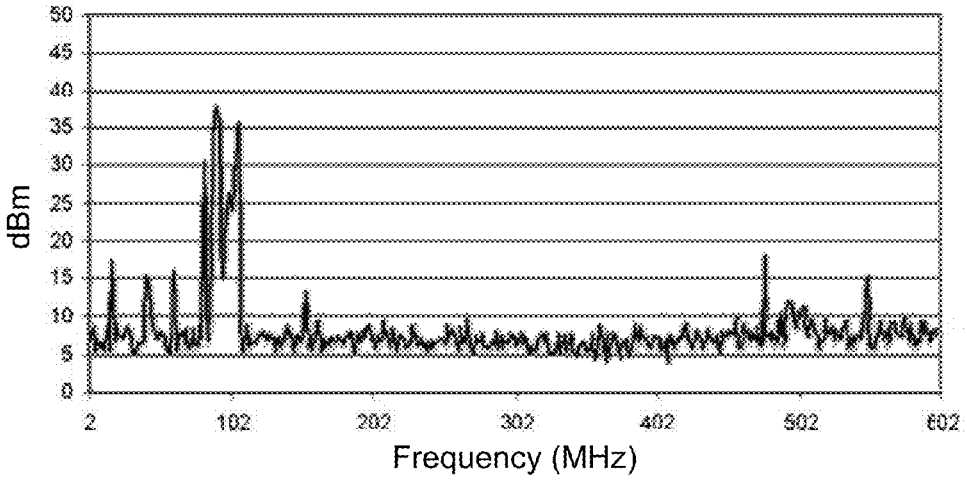
FIG. 3*b* is a plot showing various frequency responses of a human body to local broadcast television and radio signals.

FIGS. 3*a*-3*b*, for example, show how the frequency response of a body 16 to the electromagnetic signal 20 may be determined. FIG. 3*a* shows the current probe 14 positioned around a human leg 21, and also shows the current probe 14 coupled to the spectrum analyzer 40. In this embodiment, the leg 21 is exposed to the electromagnetic signals 20. FIG. 3*a* also shows how the current probe 14 may also optionally include a locking device 31 for securing the current probe 14 to the body 16. A human body, comprised of skin, muscles, bones, nerves, organs, blood, arteries, etc., in a standing position above the ground, when part of the antenna system 10, will act like a vertical polarized antenna. The human body in a prone position on the ground, when part of the antenna system 10, will act like a horizontal polarized antenna. The claimed antenna system 10 enables the direct measurement of the frequency response of a body 16 to an electromagnetic signal of interest 20. To illustrate, FIG. 3*b* shows various frequency responses of a human body having a height of about 1.67 m (5 ft, 6 in.) when exposed to local broadcast television and radio signals at a test location. The frequency responses shown in FIG. 3*b* were measured with the spectrum analyzer 40 coupled to the current probe 14, which was positioned around one of the ankles of the human leg 21 (such as is depicted in FIG. 3*a*). As shown in FIG. 3*b*, the human body had multiple frequency responses in the VLF, LF, HF, VHF and UHF regions. The major frequency responses are located in the VHF from 60 MHz to 165 MHz, which correspond to a 1.67 m tall human body. These human body frequency responses can be exploited for antenna usage. Some human body frequency responses are displayed in the HF 2 MHz to 30 MHz region. Some human body frequency responses are also displayed in the UHF frequency activities from 480 MHz to 550 MHz region that correspond to Television broadcast stations or Amateur radio stations.

Figure 4A:
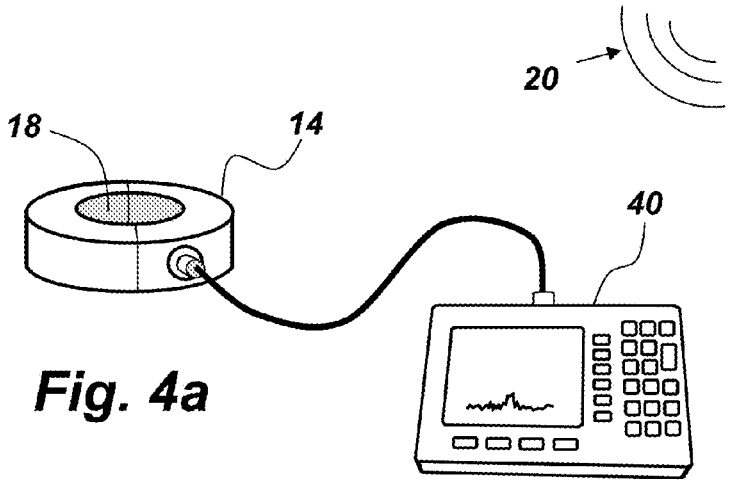
FIG. 4*a* is an illustration of a test set-up for a back-ground spectrum measurement with only a current probe and a spectrum analyzer.
Figure 4B:
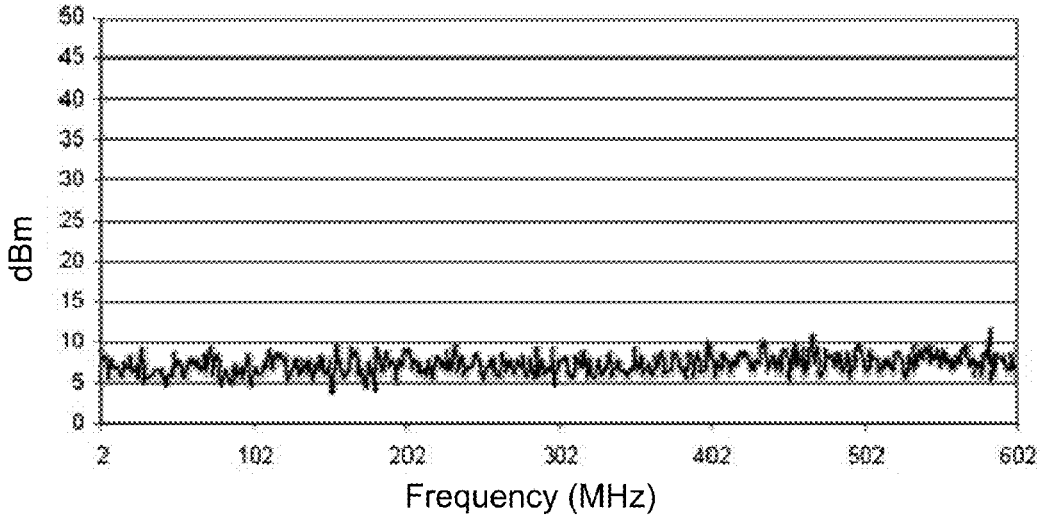
FIG. 4*b* is a plot showing the back-ground spectrum measurement corresponding to the test set-up depicted in FIG. 4*a*.

FIG. 4*a* shows the test set-up for a back ground spectrum measurement with the current probe 14 alone coupled to the spectrum analyzer 40 without any portion of a body 16 in the aperture 18. In the test set-up depicted in FIG. 4*a*, the current probe 14 has a frequency specification from 100 KHz to 400 MHz. FIG. 4*b* is a plot showing the back-ground frequency spectrum measurement from 2 MHz to 600 MHz in the same test location used to generate the plot in FIG. 3*b*, thus the current probe 14 was exposed to the same electromagnetic signals 20. The spectrum plot in FIG. 4*b* shows no activity over the VHF and UHF region due to absence of any antenna element through the current probe.

Figure 5A:
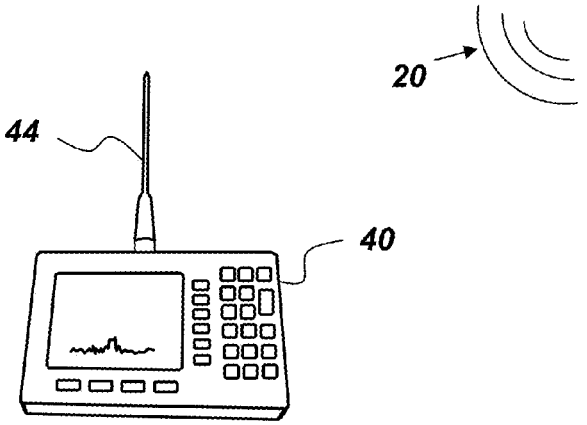
FIG. 5*a* is an illustration of a test set-up for a back-ground spectrum measurement with a standard antenna and a spectrum analyzer.
Figure 5B:
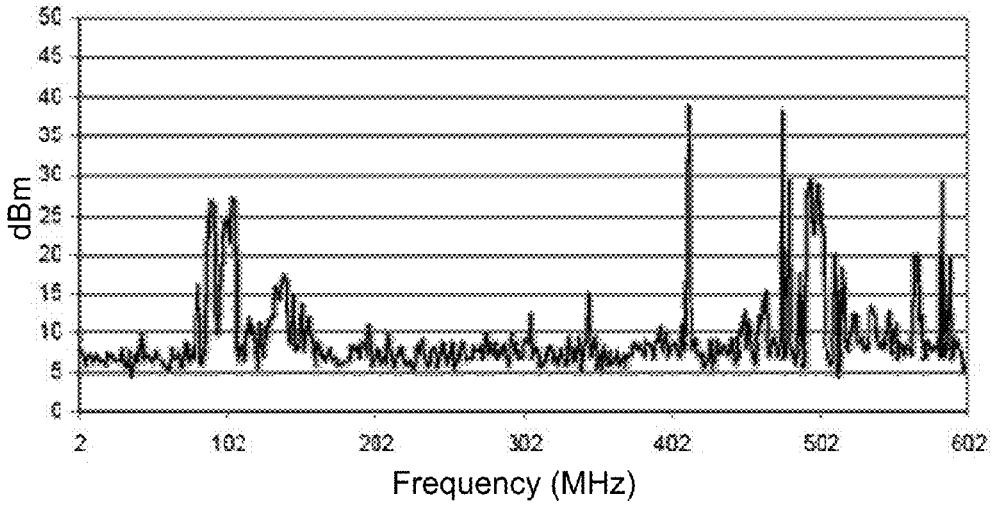
FIG. 5*b* is a plot showing the back-ground spectrum measurement corresponding to the test set-up depicted in FIG. 5*a*.

FIG. 5*a* depicts a test set-up for a back-ground spectrum measurement with a standard antenna 44 coupled to the spectrum analyzer 40. FIG. 5*b* is a spectrum plot showing the back-ground frequency spectrum measurement from 2 MHz to 600 MHz in the same test location used to generate the plots in FIGS. 3*b* and 4*b*, thus the standard antenna 44 was exposed to the same electromagnetic signals 20. The antenna used to generate the spectrum plot in FIG. 5*b* was a 20.32 cm (8 in.) Yaesu® model with VHF and UHF dual band. A back ground frequency spectrum measurement was conducted from 2 MHz to 600 MHz. The spectrum plot shows activity across the VHF and UHF region. Most of the VHF signals from 60 MHz to 165 MHz are from AM and FM radio broadcast stations or Amateur radio stations. The UHF signals from 400 MHz to 600 MHz are from television broadcast stations. In comparison, the human body frequency response amplitudes in the VHF region, shown in FIG. 3*b*, are higher than the measurements of the standard antenna 44 because the physical antenna length of the human body is longer than the shorter standard antenna 44.

Figure 6:
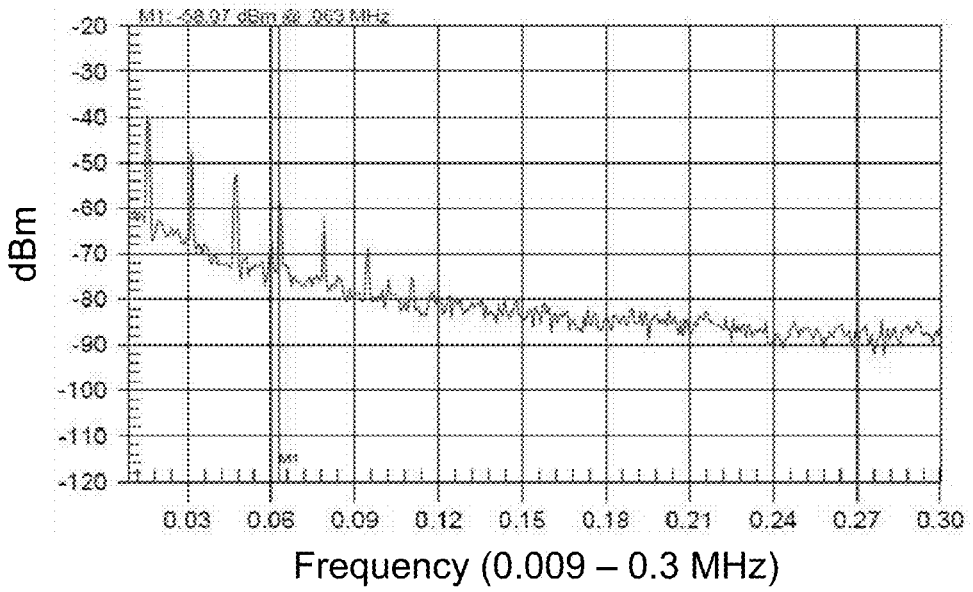
FIG. 6 is a plot showing the back-ground spectrum measurement of the antenna system depicted in FIG. 1.

The antenna system 10 in a receiving mode is useful for quantifying the level of exposure of a body 16 to low power extremely low frequency (ELF) and very low frequency (VLF) Electromagnetic Fields (EMF). FIG. 6 is a spectrum plot of the antenna system 10, as depicted in FIG. 3*a*, when exposed to induction current on the VLF frequencies (9 KHz-300 KHz) generated by the deflection coils of a household tube-type television set. The magnetic induction current probe 14 may be placed anywhere on the body 16 for contact current and induction current measurements. The antenna system 10 is also capable of transmitting signals. Signals from the transceiver 12 are conducted to the current probe 14 where the signals are magnetically coupled into the body 16, which then functions as a radiating antenna element.

Antenna characteristics of the body 16 may be used further as biometric identification. For example, in human beings, each person's body has different antenna characteristics due to differences in the size and shape of the body, skin, bones, arteries, muscles, ligaments, nerves, etc. Even the antenna characteristics of a person's left and right hand will be different. Once a person's antenna characteristics have been determined, those characteristics may be stored in a data base for future identification verification purposes much like finger-print data or retina data, as is known in the art. For example, the signal strength and bandwidth of a known signal 20, as measured by the antenna system 10, will differ slightly with each body 16 used in the system. In addition, the impedance characteristics of a given body 16 can be used as unique biometric data. A vector network analyzer (VNA) that performs both antenna analyzer measurements as well as spectrum analyzer measurements may be used for both the signal strength/bandwidth measurements and for the impedance determinations. The spectrum analyzer 40, described above, (Anritsu Site Master S311D/S312D) is an example of a suitable VNA.

Figure 7A:
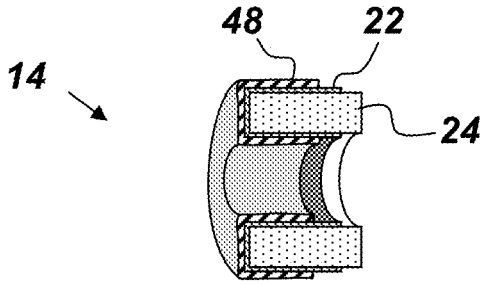
FIG. 7*a* is a layered, cross-sectional view of a current probe.
Figure 7B:
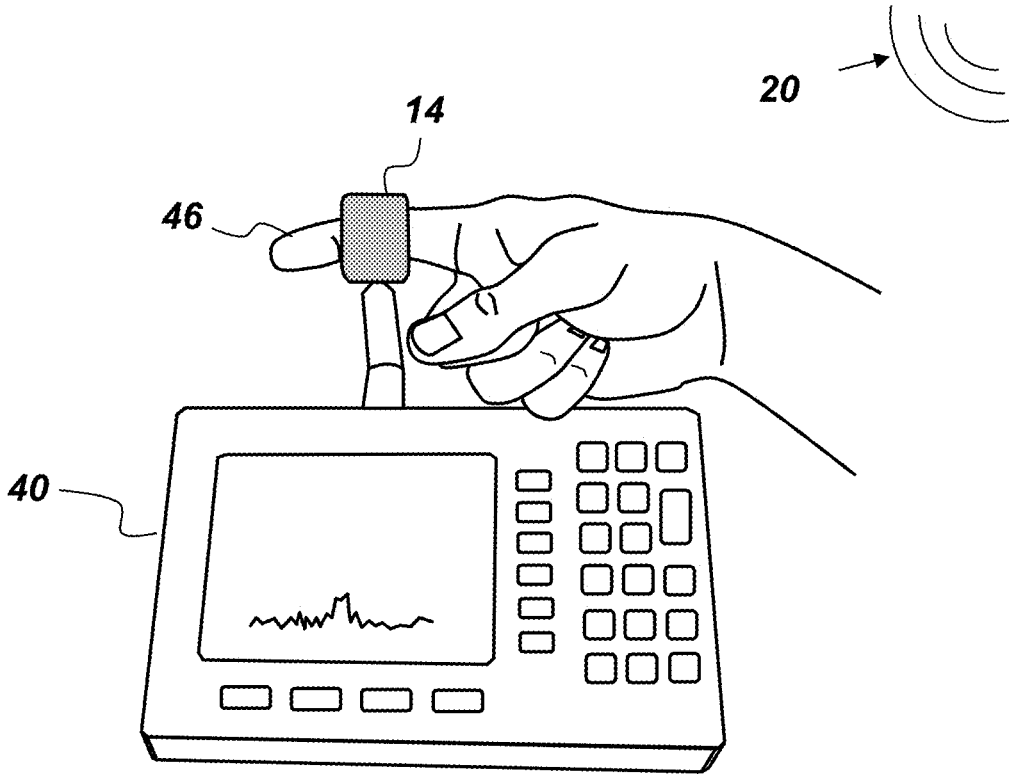
FIG. 7*b* is an illustration showing another embodiment of the antenna system 10.

FIGS. 7*a*-7*b* illustrate an embodiment of the antenna system 10 useful for measuring the specific impedance of a human finger 46 and also useful for measuring the signal strength/bandwidth of a given electromagnetic signal 20. In this embodiment, the current probe 14 is covered with a layer of insulating material 48 such that the finger 46 does not contact the conductive housing 22. FIG. 7*a* shows a perspective of the current probe 14 with a layered cross-section to facilitate viewing of the multiple layers of the current probe 14. As shown, the insulating layer 48 covers the housing 22, which in turn covers the core 24. The insulating layer 48 may be made of any suitable material that prevents electrical connection between the finger 46 and the housing 22 when the finger 48 is positioned within the aperture 18. A suitable example of the insulating layer 48 includes a plastic coating, such as Superbond Fusion for Plastic®. FIG. 7*b* is an illustration showing an embodiment of the antenna system 10 wherein the finger 48 is positioned within the aperture 18 and the current probe 14 is coupled to the spectrum analyzer 40.

Figure 8:
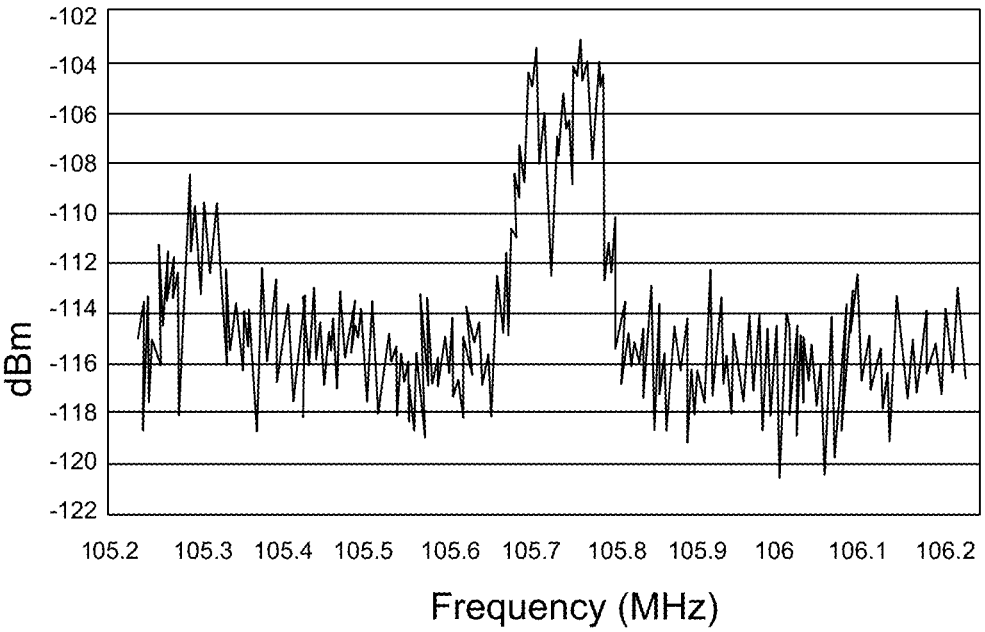
FIG. 8 is a spectrum plot of a broadcast FM radio signal, as received by the antenna system as depicted in FIG. 7*b*.

When measuring the signal strength and bandwidth of the signal 20, the signal 20 may be generated by a local signal generator connected to an antenna. Alternatively, the signal 20 may be a signal of opportunity such as local AM/FM radio stations. A collocated transmit signal from a signal generator and antenna has less environmental noise than distant AM/FM radio stations. FIG. 8 is a spectrum plot of a broadcast FM radio signal, as received by the antenna system 10 as depicted in FIG. 7*b*. A plot of measured signal strength/bandwidth by a given human finger can be used as biometric enrollment and verification for the corresponding body 16.

When determining the characteristic impedance of a portion of a given body 16 one can use a transmit signal from the VNA doing $S_{11}$ reflection measurement. The complex impedance data can be calculated from the $S_{11}$ data. The output power from the Anritsu is <0 dBm (−10 dBm nominal) for $S_{11}$ reflection measurement. The following example uses the insulated current probe 14, such as the one depicted in FIG. 7*a*, designed for 1250 MHz to determine the characteristic impedance of a human finger 46. The first step is to perform the VNA $S_{11}$ calibration using a mechanical calibration kit (Open, Short, and Load) on the reflection port, as are known to those having skill in the art. The next step is to connect the insulated current probe 14 onto the VNA reflection port and insert the human finger 46 through the aperture 18 of the current probe 14 for $S_{11}$ reflection measurement. The complex impedance can be calculated from the VNA $S_{11}$ reflection biometric measurement as described below.

Calculating the input impedance from a measured S-parameter begins with Eq. 1. Both the S-parameter and input impedance are complex numbers (R+jX), where R represents the real component, and the X represents the imaginary component. $Z_0$ is usually a real impedance of 50Ω. $S_{11}$ is the input return loss.

$$S_{11} = \frac{z_{in} - z_0}{z_{in} + z_0} \tag{1}$$

Rearrange Eq. 1 to obtain an input impedance ($Z_{in}$).

$$Z_{in} = Z_0\left(\frac{1 + s_{11}}{1 - s_{11}}\right) \tag{2}$$

Replace $S_{11}$ with R+jX.

$$Z_{in} = Z_0\left(\frac{1 + R + jX}{1 - R - jX}\right) \tag{3}$$

Multiply the denominator of Eq. 3 with its complex conjugate to separate the real and imaginary components.

$$Z_{in} = Z_0\left(\frac{1 + R + jX}{1 - R - jX}\right)\left(\frac{1 - R + jX}{1 - R + jX}\right) \tag{4}$$

$$Z_{in} = Z_0\left(\frac{1 - R^2 - X^2 + j2X}{(1 - R)^2 + X^2}\right) \tag{5}$$

Eq. 6 is the real component of the input impedance.

$$Z_{in}(\text{REAL}) = Z_0\left(\frac{1 - R^2 - X^2}{(1 - R)^2 + X^2}\right) \tag{6}$$

Eq. 7 is the imaginary component of the input impedance.

$$Z_{in}(\text{IMAGINARY}) = Z_0\left(\frac{j2X}{(1 - R)^2 + X^2}\right) \tag{7}$$

Figure 9:
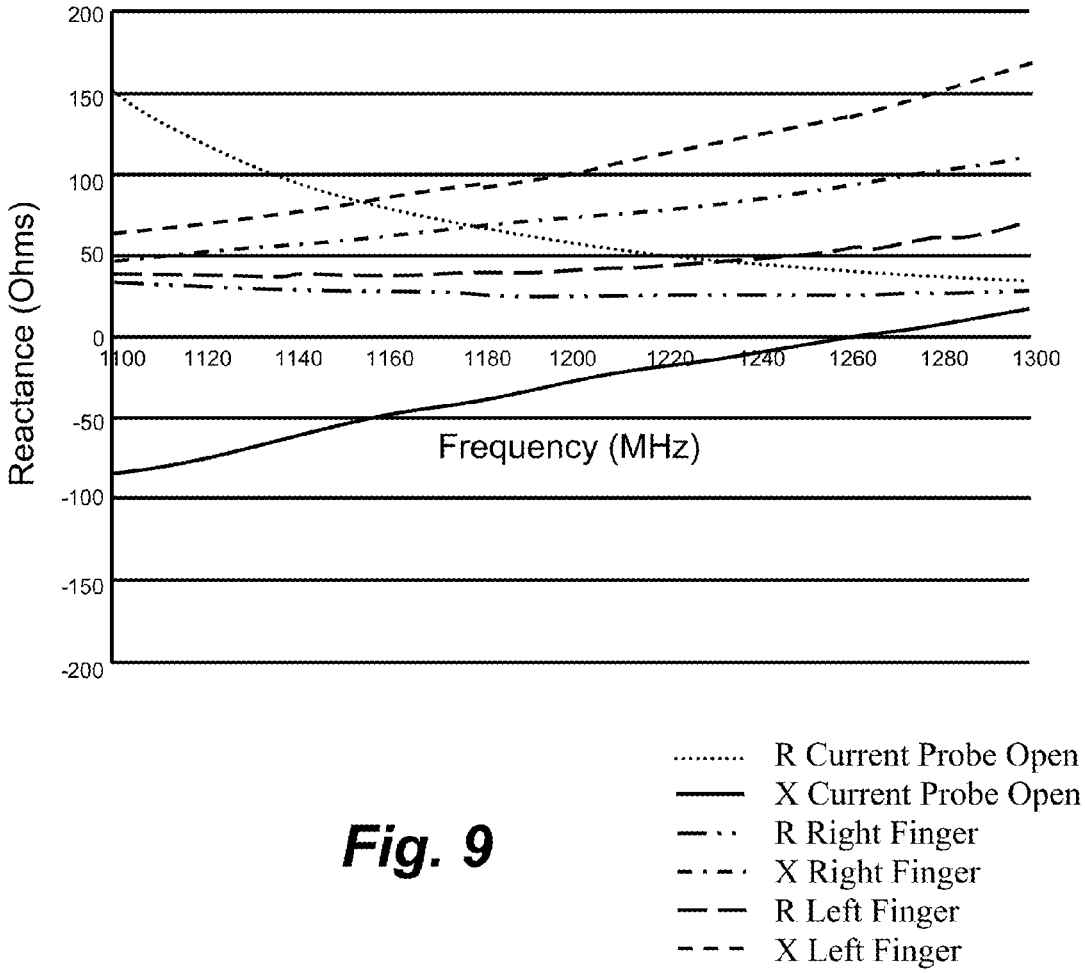
FIG. 9 is a plot of the complex impedance of a human's left and right hand finger.

FIG. 9 is a plot of an example of the complex impedance of a human's left and right hand finger. The solid and dotted curves represent the input impedance of the current probe without the human finger. The other curves represent the complex impedance of the left and right hand fingers through the current probe 14. These complex impedance characteristic can be used for biometric enrollment and verification purposes. In practice, the VNA with spectrum analyzer option can measure the $S_{11}$ reflection and signal strength and bandwidth characteristics of the finger, which characteristics may then be stored on a remote computer. Alternatively, the measured characteristics may be compared with stored characteristics in a database to determine if there is a match. If a matching phase is being performed, the measured characteristics data is passed to an impedance matcher and signal strength and bandwidth matcher that compare the data with stored characteristic data using any suitable correlation algorithm (e.g. the Pearson product-moment correlation coefficient, or "Pearson's correlation"). The matching program will analyze the measured characteristic data with the stored characteristic data.

Figure 10A:
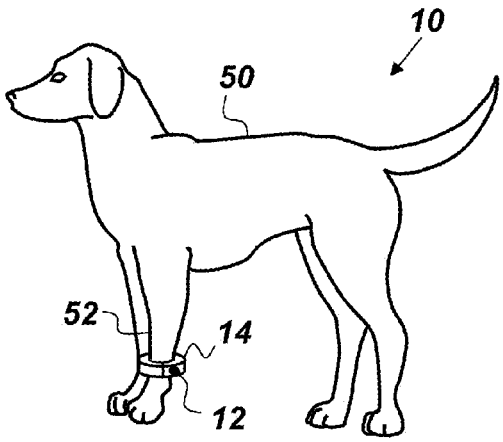
FIGS. 10*a*-10*c* are illustrations of other embodiments of the antenna system.
Figure 10B:
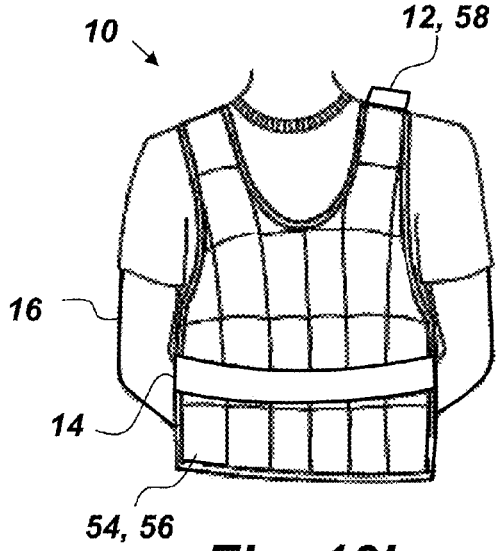
Figure 10C:
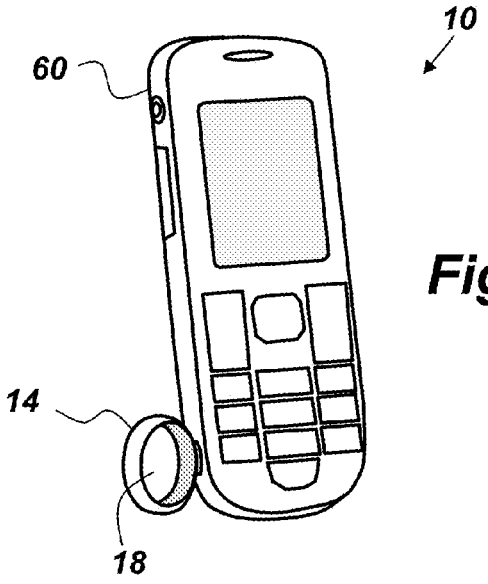

FIGS. 10*a*-10*c* are illustrations of several other embodiments of the antenna system 10. FIG. 10*a* depicts an embodiment of antenna system 10 wherein the body 16 is that of a canine 50. In the embodiment shown in FIG. 10*a*, the current probe 14 is positioned around the dog's leg 52. FIG. 10*b* shows an embodiment of the antenna system 10 wherein the current probe 14 is made of flexible material and integrated into an article of clothing 54, which in this case is a life vest 56. The antenna system 10 may further comprise a global positioning system (GPS) device 58 coupled to the transceiver 12. In the embodiment of the antenna system 10 depicted in FIG. 10*c*, the transceiver 12 is integrated into a personal cell phone 60 and the current probe 14 is configured to be releasably connected to the cell phone such that when a finger 46 (not shown) is inserted through the aperture 18, the finger 46 and current probe 14 function as the antenna for the cell phone 60. In the embodiment shown in FIG. 10*c*, the current probe 16 has the size and shape of a ring, which may be worn on the finger 46 when not connected to the cell phone 60.

From the above description of the Animal Body Antenna, it is manifest that various techniques may be used for implementing the concepts of antenna system 10 without departing from its scope. The described embodiments are to be considered in all respects as illustrative and not restrictive. It should also be understood that antenna system 10 is not limited to the particular embodiments described herein, but is capable of many embodiments without departing from the scope of the claims.

I claim:

1. An antenna comprising:

a transceiver;

a current probe operatively coupled to the transceiver, wherein the current probe comprises an outer conductive non-magnetic housing, a toroidal magnetic core having a central aperture, and a primary winding wound about the core, wherein the core is insulated from the housing; and an animal body, a portion of which is positioned within the aperture such that incoming and outgoing electromagnetic signals are transferred between the portion of the animal body and the current probe by magnetic induction, wherein the conductive non-magnetic housing is covered with a non-conductive membrane such that the portion of the animal body does not come into contact with the conductive non-magnetic housing.

2. The antenna of claim 1, wherein the primary winding comprises a first end configured to transmit and receive RF energy and a second end, wherein the primary winding is insulated from the housing between the first end and the second end, and wherein the second end of the primary winding connects to the outer conducting non-magnetic housing.

3. The antenna of claim 2, wherein the first end of the primary winding connects to an unbalanced to unbalanced transmission line transformer.

4. The antenna of claim 2, wherein the animal body is a human body.

5. The antenna of claim 4, wherein the current probe is a ring configured to be worn on a finger of the human body.

6. The antenna of claim 4, wherein the current probe has the appearance of an article of jewelry.

7. The antenna of claim 4, wherein the current probe is made of a flexible material which is integrated into an article of clothing.

8. The antenna of claim 2, wherein the current probe is integrated into a personal flotation device.

9. The antenna of claim 4, wherein the transceiver is electrically coupled to a personal cell phone.

10. The antenna of claim 4, wherein the transceiver is electrically coupled to a personal wireless microphone.

11. The antenna of claim 2, wherein the animal body is a non-human body.

12. The antenna of claim 4, wherein the current probe further comprises a locking device such that the current probe may be locked to the human body and wherein the transceiver is operatively coupled to a global positioning system (GPS) device.

13. A method for using an animal body as an antenna element comprising the following steps:

providing a current probe, wherein the current probe comprises a conductive non-magnetic housing, a toroidal magnetic core having a central aperture, and a primary winding wound about the core, wherein the core is insulated from the housing;

positioning a portion of the animal body within the aperture, wherein the conductive non-magnetic housing is covered with a non-conductive membrane such that the portion of the animal body does not come into contact with the conductive non-magnetic housing;

exposing the animal body to an electromagnetic signal;

sensing with the current probe by way of magnetic induction a current in the animal body; and determining antenna characteristics of the portion of the animal body based on the sensed current.

14. The method of claim 13 further comprising determining a whole body frequency response of the animal body to a back-ground spectrum from the electromagnetic signal by:

a. measuring the back-ground spectrum with a spectrum analyzer coupled to the current probe when the portion of the animal body is positioned within the aperture; and b. generating a spectrum plot with the spectrum analyzer showing the animal body frequency responses to the back-ground spectrum.

15. The method of claim 13, wherein the electromagnetic signal is a communications signal and further comprising the steps of:

operatively coupling a transceiver to the current probe;

receiving the electromagnetic signal with the animal body; and transferring the electromagnetic signal from the animal body to the transceiver via the current probe by way of magnetic induction.

16. The method of claim 15 further comprising using the animal body as a radiating antenna element by transferring an electromagnetic signal from the transceiver through the current probe to the animal body by way of magnetic induction.

17. The method of claim 13, wherein the animal body is a human body.

18. The method of claim 17 further comprising the steps of:

operatively coupling a spectrum analyzer to the current probe and measuring the signal strength and bandwidth of the electromagnetic signal; and storing on a computer the signal strength and bandwidth measurements as biometric information of the human body.

19. The method of claim 17 further comprising calculating complex impedance of the portion of the human body by:

performing a vector network analyzer (VNA) $S_{11}$ calibration using a VNA mechanical calibration kit on a reflection port of the VNA;

operatively coupling the current probe to the reflection port of the VNA;

measuring the $S_{11}$ reflection at the reflection port when the portion of the human body is positioned within the aperture of the current probe;

calculating the complex impedance of the portion of the human body based on the $S_{11}$ reflection measurements; and storing on a computer the $S_{11}$ reflection measurements as biometric information corresponding to the portion of the human body.

* * * * *